US005852977A

United States Patent [19]

Lynch

[11] Patent Number: 5,852,977

[45] Date of Patent: Dec. 29, 1998

[54] SELF SERVICE PRINT TERMINAL

[75] Inventor: Andrew Lynch, Dundee, Scotland

[73] Assignee: NCR Corporation, Dayton, Ohio

[21] Appl. No.: 804,648

[22] Filed: Feb. 25, 1997

[30] Foreign Application Priority Data

Sep. 13, 1996 [GB] United Kingdom ..... 9619191

[51] Int. Cl.[6] ..... G07B 1/00; G07B 11/11

[52] U.S. Cl. ..... 101/232; 101/66

[58] Field of Search ..... 101/232, 66

[56] References Cited

U.S. PATENT DOCUMENTS

| | | | |
|---|---|---|---|
| 2,773,446 | 12/1956 | Koeber, Jr. | 101/232 |
| 3,517,612 | 6/1970 | Stucchi | 101/66 |
| 4,027,142 | 5/1977 | Paup et al. | 235/61.9 R |
| 4,329,572 | 5/1982 | Lovrich et al. | 235/92 EC |
| 4,381,705 | 5/1983 | Roes et al. | 101/66 |
| 4,385,285 | 5/1983 | Horst et al. | 235/379 |
| 4,992,647 | 2/1991 | Konishi et al. | 235/379 |
| 5,373,115 | 12/1994 | Manduley et al. | 177/50 |

FOREIGN PATENT DOCUMENTS

| | | |
|---|---|---|
| 57-125466 | 8/1982 | Japan . |
| 9-027049 | 1/1997 | Japan . |
| 2238415 | 5/1991 | United Kingdom . |

*Primary Examiner*—Edgar Burr
*Assistant Examiner*—Daniel J. Colilla
*Attorney, Agent, or Firm*—Michael Chan

[57] ABSTRACT

A self service financial print terminal (10) has a keypad (14) to input instructions; a card reader (44) to read a data-bearing user card; and a printer (20) to print a financial document such as a cheque in accordance with instructions. A correctly-printed cheque is driven by pairs of rollers (22,24) to a delivery slot (18). An incorrectly-printed cheque is diverted by divert mechanism (30) to pass between a pair of print rollers (34) which print a stripe on the cheque in indelible security ink. The marked cheque can then be retained in a non-secure part of the terminal (36).

5 Claims, 3 Drawing Sheets

SELF SERVICE PRINT TERMINAL

BACKGROUND OF THE INVENTION

This invention relates to a self service print terminal, especially to such a terminal which can print financial documents such as cheques.

In addition to the well known automated teller machine (ATM) which allows self service dispensing of currency notes, self service terminals are available which, in a self service transaction, print documents such as cheques, insurance cover notes, loan records, and the like. Inevitably, an error may occur in printing such documents.

SUMMARY OF THE INVENTION

It is the object of the invention to provide a self service print terminal in which documents with printing errors cannot be used fraudulently.

According to the invention there is provided a self service financial print terminal comprising input means; a card reader; and a printer to print a financial document; characterized by further print means to print on incorrectly printed documents a permanent indication of invalidity.

BRIEF DESCRIPTION OF THE DRAWINGS

The invention will now be described by way of example only with reference to the accompanying drawings in which.

DETAILED DESCRIPTION

Figure 1:
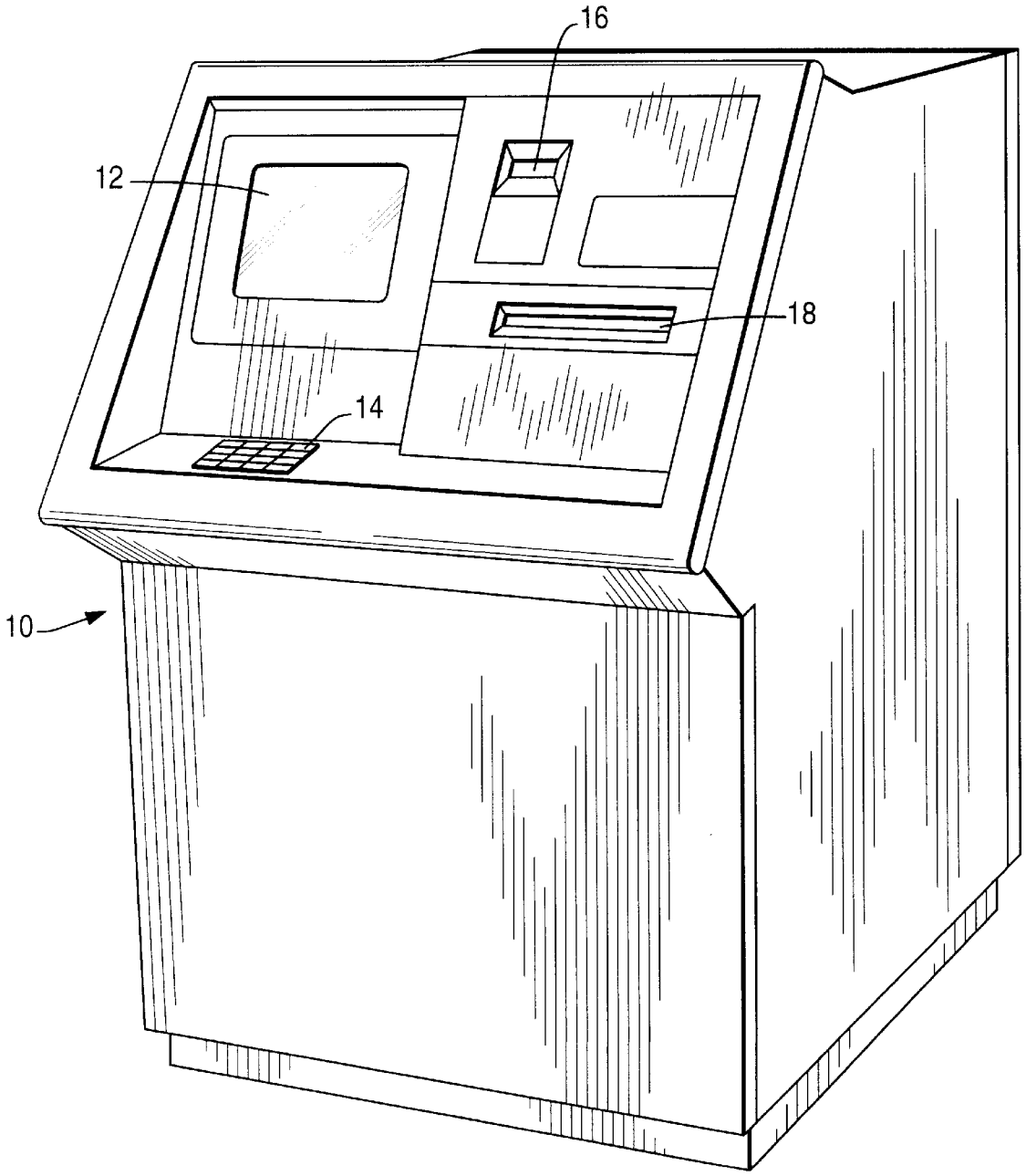
FIG. 1 is a view of a self service terminal.

In FIG. 1, a self service financial terminal 10 has a display screen 12, keypad 14, user card input slot 16, and document delivery slot 18. In use, the user inserts a magnetically encoded card into the slot 16, and enters a personal identity number (PIN) via the keypad 14. After authorization of the card and PIN by the financial authority operating the terminal, the user can request, via the keypad 14, a document such as a cheque to be printed, and delivered through the slot 18.

Figure 2:
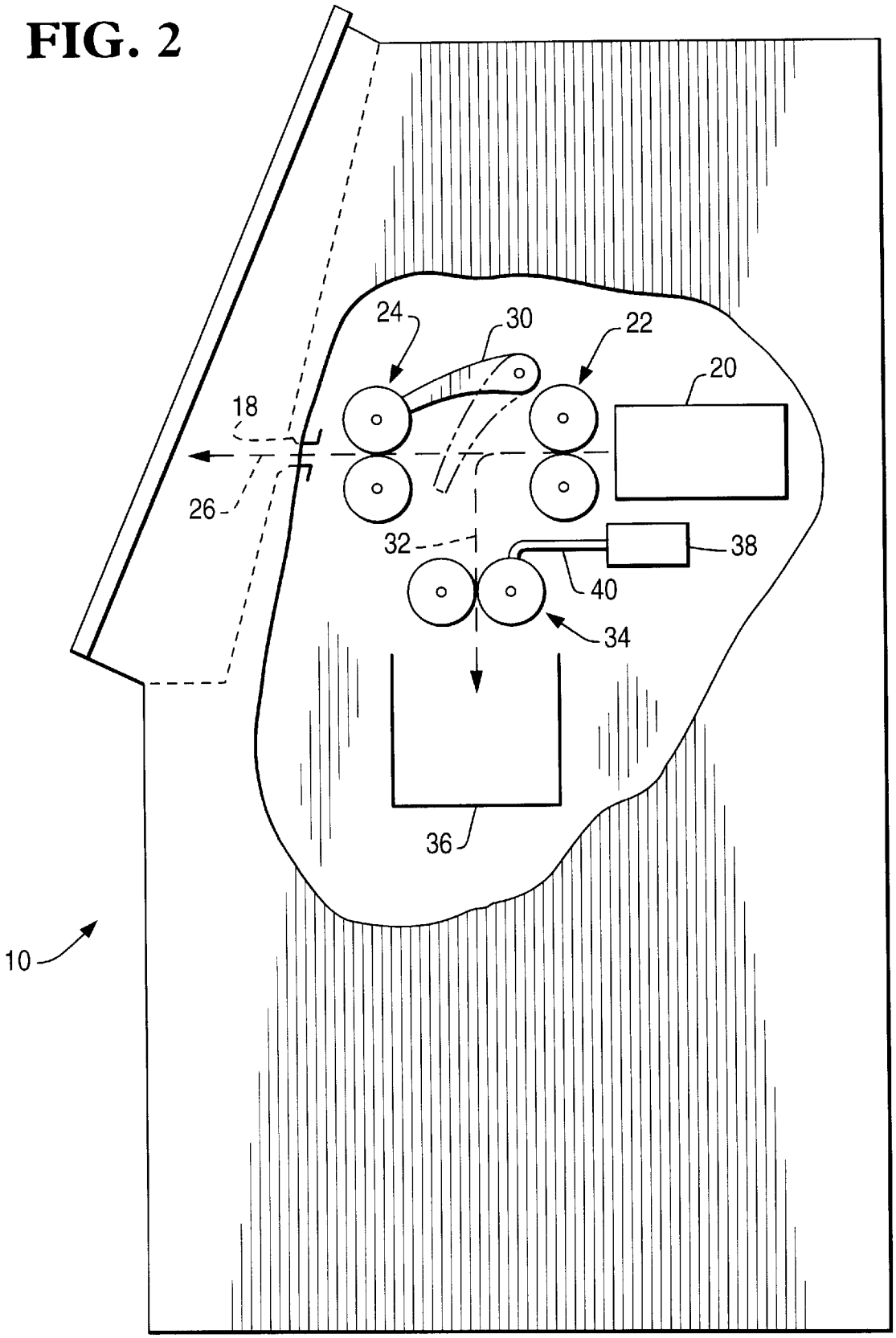
FIG. 2 is a partially cut-away side view of a self service terminal.

FIG. 2 shows the internal operation of the terminal 10. A printer 20 prints the cheque and outputs it to a first pair of rollers 22 which drive the cheque to a second pair of rollers 24, which pass it through the delivery slot 18, the cheque following the path shown by the dotted line 26.

If however an error occurs, for example the user keys in an incorrect sum of money but does not realize this until the cheque has been printed, the user can indicate the existence of an error by the keypad 14. In this case, a divert mechanism 30 is operated to move from its position shown by the solid line to its position shown dotted; the cheque is then diverted along the path shown by the dotted line 32 to pass between a pair of print rollers 34 into a storage container 36. Adjacent the print rollers 34 is an ink reservoir 38 connected by tube 40 having its other end lying above one of the rollers of the pair 34; when the cheque passes through the print rollers 34, it is marked with a stripe along its length to show that it is invalid. The ink in the reservoir 38 is an indelible security ink of known composition.

Since the cheque printed in error is clearly and indelibly indicated as invalid, it is not necessary to retain it in a secure enclosure. The container 36 need not be in a secure capture area of the terminal 10.

Figure 3:
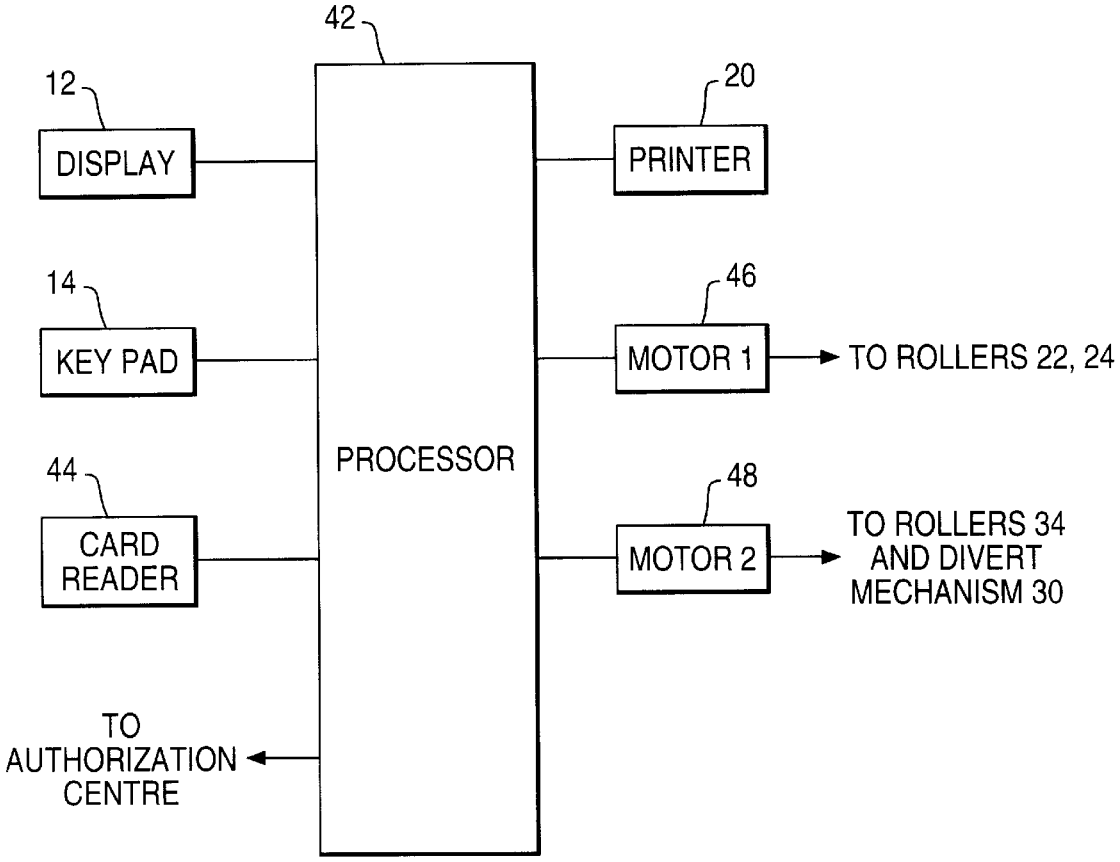
FIG. 3 illustrates a control system for a self service terminal.

FIG. 3 shows the control arrangements for the terminal. A processor 42 is connected to the display 12, keypad 14, a card reader 44 behind the card input slot 16 (see FIG. 1), and to the authorization center of the financial organization operating the terminal, and also to the printer 20.

The processor 42 is also connected to a first motor 46, which drives the first and second pairs of rollers 22, 24, and to a second motor 48, which drives the print rollers 34 and the divert mechanism 30.

The processor 42 accepts information from the keypad 14 and from the card reader 44, communicates with the authorization center, and provides suitable messages on the display 12. The processor also controls the printer 20, and operates the motor 46 to drive the pairs of rollers 22,24 to provide an error-free cheque to the user. For an error-containing cheque the processor 42 operates a motor 48 to swing the divert mechanism 30 into the divert position, and to operate the print rollers 34 to print a stripe onto the invalid cheque.

What is claimed is:

1. A self-service financial terminal for producing a valuable document to be delivered to a customer at the self-service financial terminal, the self-service financial terminal comprising:

a card reader for receiving a user identifying card from a customer to verify the identity of the customer to allow the customer to gain access to services provided by the self-service terminal;

a container for storing sheets on which information is to be printed to provide valuable documents to be delivered to customers;

a first printer mechanism for printing information onto a sheet which has been transported from the container to the first printer mechanism to produce a valuable document;

a second printer mechanism for printing an indicia of invalidity onto a valuable document which has been produced at the first printer mechanism and transported from the first printer mechanism to the second printer mechanism;

an input device for receiving inputs from the customer to provide information to be printed onto a sheet which has been transported from the container to the first printer mechanism to produce a valuable document; and a processor for (i) controlling the first printer mechanism to print information onto a sheet which has been transported from the container to the first printer mechanism in response to inputs received from the customer via the input device requesting that a valuable document be produced and delivered to the customer, and (ii) controlling the second printer mechanism to print an indicia of invalidity onto the valuable document which has been produced at the first printer mechanism and transported from the first printer mechanism to the second printer mechanism to render the valuable document invalid in response to inputs received from the customer via the input device indicating that the valuable document has incorrect information printed thereon.

2. A self-service financial terminal according to claim 1, further comprising (i) a drive mechanism for moving a valuable document having correct information printed thereon to a slot to deliver the valuable document to a customer, and (ii) a divert mechanism for diverting a valuable document having incorrect information printed thereon from the first printer mechanism to the second printer mechanism to allow the second printer mechanism to print an indicia of invalidity onto the valuable document to render the valuable document invalid.

3. A self-service financial terminal according to claim 1, wherein the second printer mechanism includes a pair of print rollers and a reservoir for supplying ink to the print rollers.

4. A self-service financial terminal according to claim 3, wherein the ink is an indelible security ink.

5. A self-service financial terminal for producing a valuable document to be delivered to a customer at the self-service financial terminal, the self-service financial terminal comprising:

a card reader for receiving a user identifying card from a customer to verify the identity of the customer to allow the customer to gain access to services provided by the self-service terminal;

a container for storing sheets on which information is to be printed to provide valuable documents to be delivered to customers;

a first printer mechanism for printing information onto a sheet which has been transported from the container to the first printer mechanism to produce a valuable document;

a second printer mechanism for printing an indicia of invalidity onto a valuable document which has been produced at the first printer mechanism and transported from the first printer mechanism to the second printer mechanism, the second printer mechanism including a pair of print rollers and a reservoir for supplying an indelible security ink to the print rollers;

a drive mechanism for moving a valuable document having correct information printed thereon to a slot to deliver the valuable document to a customer;

a divert mechanism for diverting a valuable document having incorrect information printed thereon from the first printer mechanism to the second printer mechanism to allow the print rollers of the second printer mechanism to print an indicia of invalidity using indelible security ink onto the valuable document to render the valuable document invalid;

an input device for receiving inputs from the customer to provide information to be printed onto a sheet which has been transported from the container to the first printer mechanism to produce a valuable document; and a processor for (i) controlling the first printer mechanism to print information onto a sheet which has been transported from the container to the first printer mechanism in response to inputs received from the customer via the input device requesting that a valuable document be produced and delivered to the customer, and (ii) controlling the print rollers of the second printer mechanism to print an indicia of invalidity using indelible security ink onto the valuable document which has been produced at the first printer mechanism and transported from the first printer mechanism to the second printer mechanism to render the valuable document invalid in response to inputs received from the customer via the input device indicating that the valuable document has incorrect information printed thereon.

* * * * *